US008350645B2

(12) United States Patent
Yeon

(10) Patent No.: US 8,350,645 B2
(45) Date of Patent: Jan. 8, 2013

(54) HIGH VOLTAGE RELAY

(75) Inventor: Young Myoung Yeon, Chungcheongbuk-Do (KR)

(73) Assignee: LS Industrial Systems Co., Ltd., Seoul (KR)

( * ) Notice: Subject to any disclaimer, the term of this patent is extended or adjusted under 35 U.S.C. 154(b) by 52 days.

(21) Appl. No.: 12/904,076

(22) Filed: Oct. 13, 2010

(65) Prior Publication Data

US 2011/0156846 A1 Jun. 30, 2011

(30) Foreign Application Priority Data

Dec. 31, 2009 (KR) ..... 10-2009-0136232

(51) Int. Cl.
*H01H 51/22* (2006.01)

(52) U.S. Cl. ..... 335/78; 335/201

(58) Field of Classification Search ..... 335/201
See application file for complete search history.

(56) References Cited

U.S. PATENT DOCUMENTS

| | | | | |
|---|---|---|---|---|
| 4,429,198 | A * | 1/1984 | Mori et al. | 218/149 |
| 4,866,226 | A * | 9/1989 | Hisatsune et al. | 218/37 |
| 5,880,653 | A * | 3/1999 | Yamada et al. | 335/78 |
| 5,969,586 | A * | 10/1999 | Noda et al. | 335/83 |
| 6,138,714 | A * | 10/2000 | Kim | 137/614.05 |
| 6,265,958 | B1 | 7/2001 | Yoshino et al. | |
| 7,410,527 | B2 * | 8/2008 | Wagner et al. | 95/271 |

FOREIGN PATENT DOCUMENTS

| | | |
|---|---|---|
| JP | U59-138149 | 9/1984 |
| JP | 64000627 | 1/1989 |
| JP | 07-220558 | 8/1995 |
| JP | 2005183283 | 7/2005 |
| KR | 10-0131864 | 4/1998 |
| KR | 1020060036506 | 5/2006 |

* cited by examiner

*Primary Examiner* — Elvin G Enad
*Assistant Examiner* — Lisa Homza
(74) *Attorney, Agent, or Firm* — Lee, Hong, Degerman, Kang & Waimey

(57) ABSTRACT

Disclosed is a high voltage relay having an enhanced air-tight structure, the relay including a molded case formed by molding a synthetic resin having an electric insulating property into a box shape having one open surface, an actuator accommodated in the lower molded case, and an arc extinguishing mechanism allowing insertion of a stationary electrode therein and installed on the actuator for covering the open surface of the molded case, the arc extinguishing mechanism including a gas discharge hole portion blocked when a thermosetting resin coated on the arc extinguishing mechanism for air-tightness is hardened.

1 Claim, 5 Drawing Sheets

HIGH VOLTAGE RELAY

CROSS-REFERENCE TO RELATED APPLICATION

Pursuant to 35 U.S.C. §119(a), this application claims the benefit of earlier filing date and right of priority to Korean Application No. 10-2009-0136232, filed on Dec. 31, 2009, the contents of which is incorporated by reference herein in its entirety.

BACKGROUND OF THE INVENTION

1. Field of the Invention

The present invention relates to a high voltage direct current (DC) relay for hybrid vehicles or electric vehicles, and particularly, to an air-tight high voltage DC relay for hybrid vehicles or electric vehicles having an enhanced air-tight structure.

2. Background of the Invention

A hybrid vehicle accelerates using electric energy of a battery at an initial running of the vehicle and when reaching a predetermined driving speed, it moves by using an engine as a power source with blocking an electric power supply from the battery. Here, a high voltage direct-current (DC) relay is used for supplying or blocking the battery power. High voltage DC relays for the hybrid vehicles or electric vehicles are classified into a main relay and a sub relay. Typically, a gas-tight high voltage DC relay is widely used as the main relay, and a high voltage DC relay in the air is widely used as the sub relay. The main relay is configured by forming an arc extinguishing mechanism with a vacuum container made of ceramic, so it may less affect the usage environments. On the other hand, the sub relay is fabricated to be arc-extinguished in the air, so the operation reliability on the usage environment is important. Especially, since the operation reliability on usage environments of temperature and humidity is emphasized, a performance of maintaining an air-tight state is important for the high voltage DC relay in the air, accordingly, a method for maintaining the air-tightness is very important.

The present invention is to provide the high voltage DC relay in the air having an enhanced performance of maintaining an air-tight state, and a method for fabricating the same, in the high voltage DC relay in the air used as a sub relay for hybrid vehicles or electric vehicles.

Hereinafter, description will be given of a high voltage DC relay in the air and a fabrication method thereof according to the related art, with reference to FIG. 1.

The high voltage DC relay in the air according to the related art includes a molded case 1 in a box shape having one open surface, an actuator (e.g., see the reference numeral 2 of FIG. 2) accommodated within the molded case 1, and an arc extinguishing mechanism 3 installed on the actuator for covering the open surface of the molded case 1.

The high voltage DC relay in the air according to the related art can be assembled by accommodating the actuator within the molded case 1 with upwardly situating the open surface, and covering the open surface of the molded case 1 by laying the arc extinguishing mechanism 3 on the actuator.

Afterwards, for enhancing the air-tightness, a thermosetting resin 4 having high temperature is deposited thereon. While the thermosetting resin 4 is cooled to be hardened, an expanded air within the molded case 1 by the high temperature, is discharged, as indicated with an arrow in FIG. 2, into the external air via gaps formed at, for example, a boundary portion between the molded case 1 and the arc extinguishing mechanism 3, a portion near a stationary electrode, a portion near a coil terminal and the like.

Consequently, due to the gaps formed at those portions, the related art high voltage DC relay in the air cannot be maintained in the air-tight state. Furthermore, its operation reliability depends on the environmental variations of temperature and humidity, so the reliability cannot be ensured. Also, foreign materials such as dust or water can be introduced via the gaps.

SUMMARY OF THE INVENTION

Therefore, to solve the problems of the related art, an object of the present invention is to provide a high voltage relay having an enhanced air-tight structure, and a fabrication method thereof.

To achieve these and other advantages and in accordance with the purpose of the present invention, as embodied and broadly described herein, there is provided a high voltage relay, the relay including a molded case formed by molding a synthetic resin having an electric insulating property into a box shape having one open surface, an actuator accommodated in the lower molded case, and an arc extinguishing mechanism allowing insertion of a stationary electrode therein and installed on the actuator for covering the open surface of the molded case, the arc extinguishing mechanism including a gas discharge hole portion blocked when a thermosetting resin coated on the arc extinguishing mechanism for air-tightness is hardened.

In accordance with one embodiment of the present invention, there is provided a method for fabricating a high voltage relay including a components preparation step of preparing a molded case formed by molding a synthetic resin having an electric insulating property into a box shape having one open surface, an actuator accommodated in the molded case, and an arc extinguishing mechanism allowing insertion of a stationary electrode therein, having a gas discharge hole portion, and installed to cover the open surface of the molded case, an assembly step of accommodating the actuator in the molded case and covering the arc extinguishing mechanism, a coating step of coating a thermosetting resin on the arc extinguishing mechanism excluding the gas discharge hole portion, and a blocking step of blocking a gas discharge hole of the gas discharge hole portion when an expanded gas within the molded case is completely discharged out through the gas discharge hole portion.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, the object of the present invention, the configuration for achieving the object and operational effects thereof will be understood more obviously by a detailed description of the preferred embodiment according to the present invention, with reference to the accompanying drawings.

Figure 1:
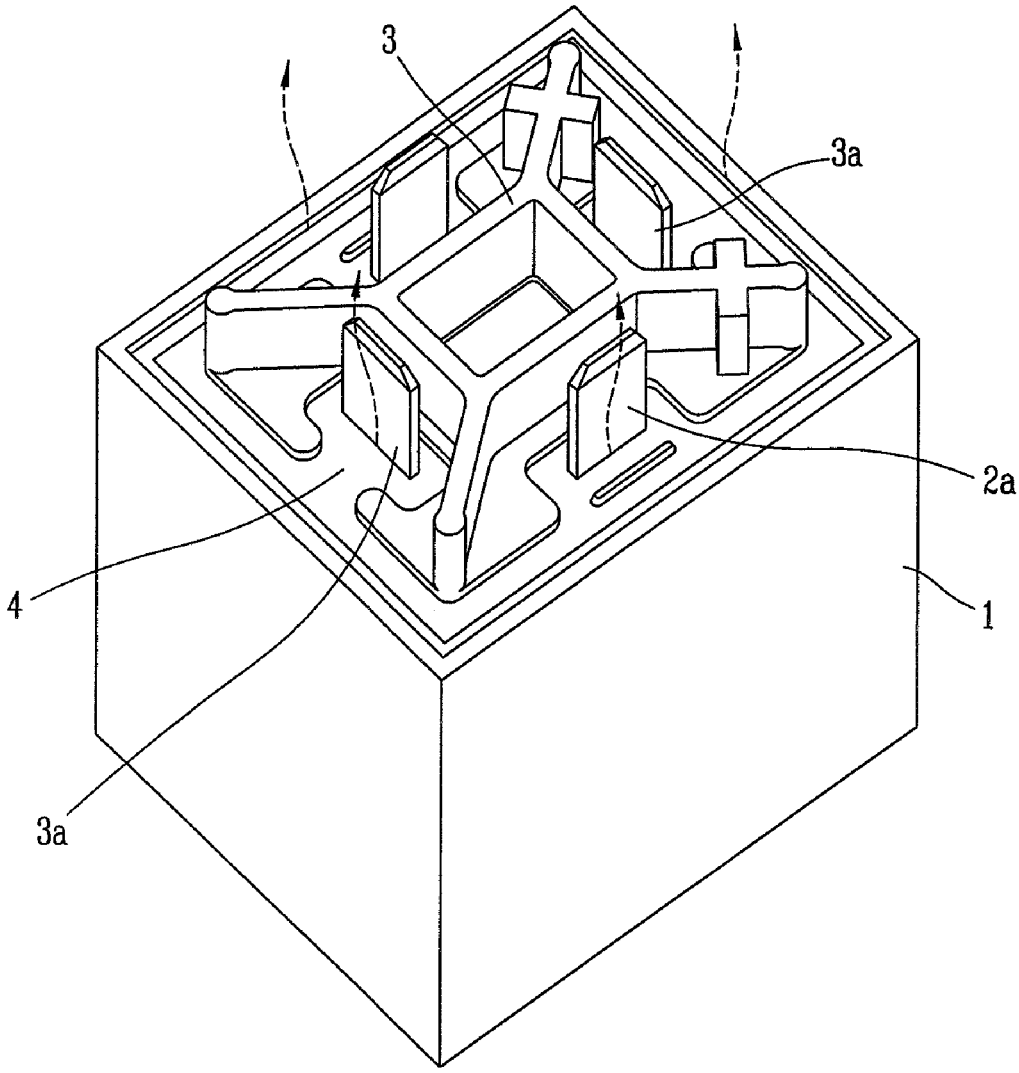
FIG. 1 RELATED ART
FIG. 1 is a perspective view showing a discharged state of expanded internal air due to a temperature increase within a relay after coating a thermosetting epoxy upon fabrication of a high voltage relay according to the related art.
Figure 2:
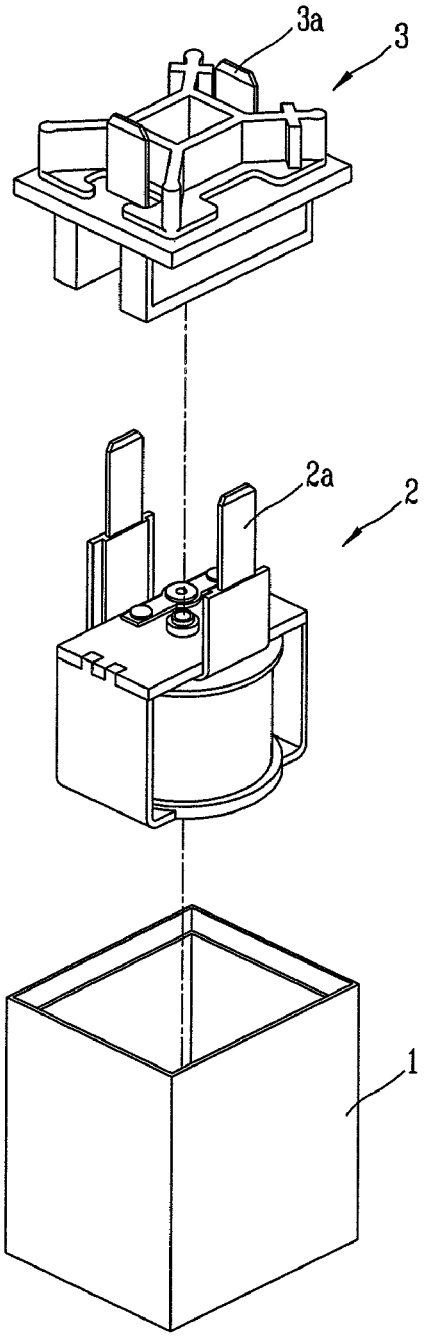
FIG. 2 is a disassembled perspective view showing components in a high voltage relay according to the present invention.
Figure 3:
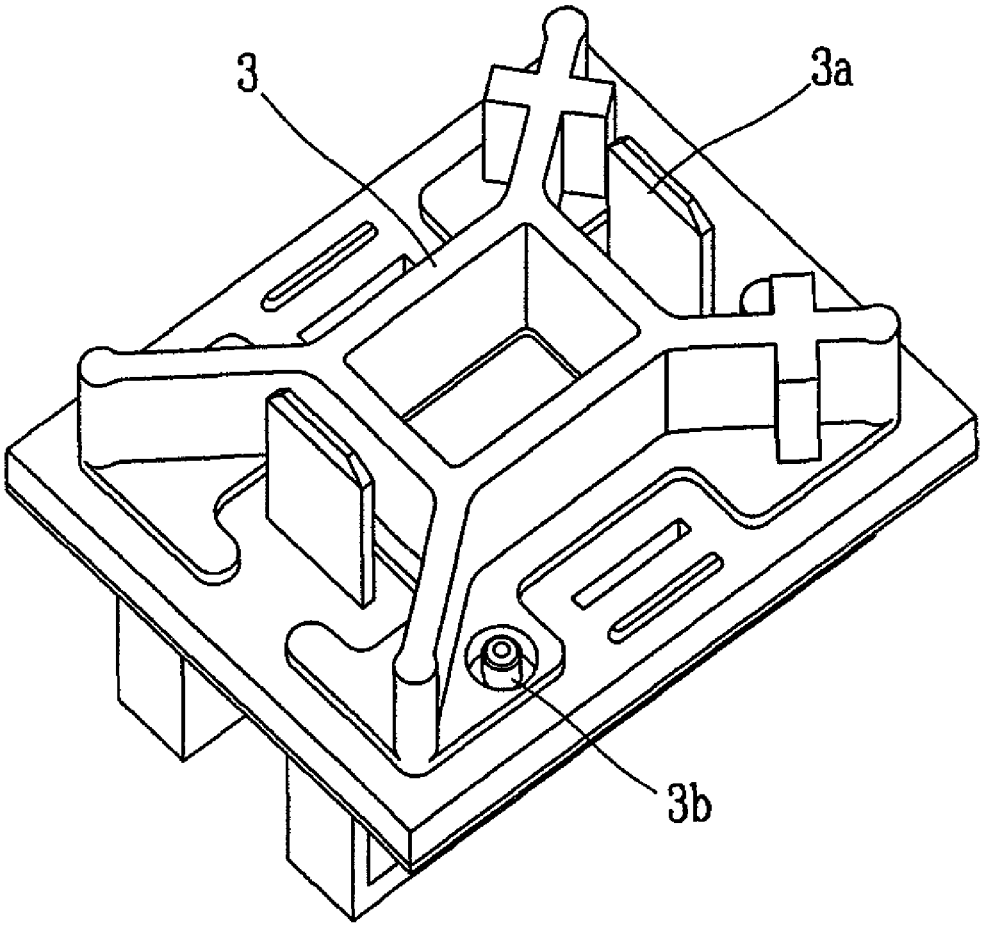
FIG. 3 is a perspective view showing a configuration of an arc extinguishing mechanism in the high voltage relay in accordance with the present invention.
Figure 4:
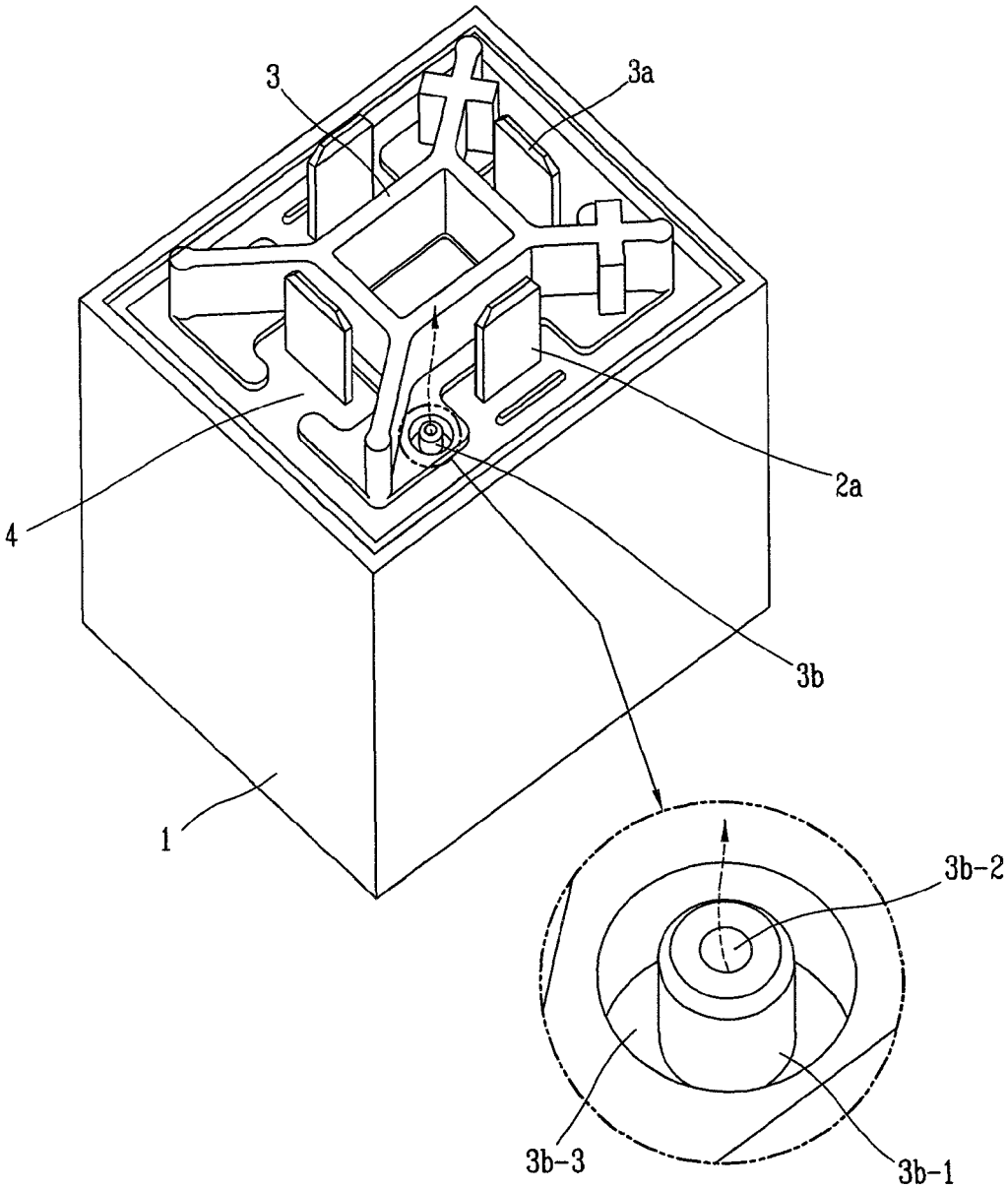
FIG. 4 is a perspective view showing that internal air expanded due to a temperature increase within the relay is discharged through a gas discharge hole portion in a thermosetting resin-coated state, and an enlarged view of a main part.
Figure 5:
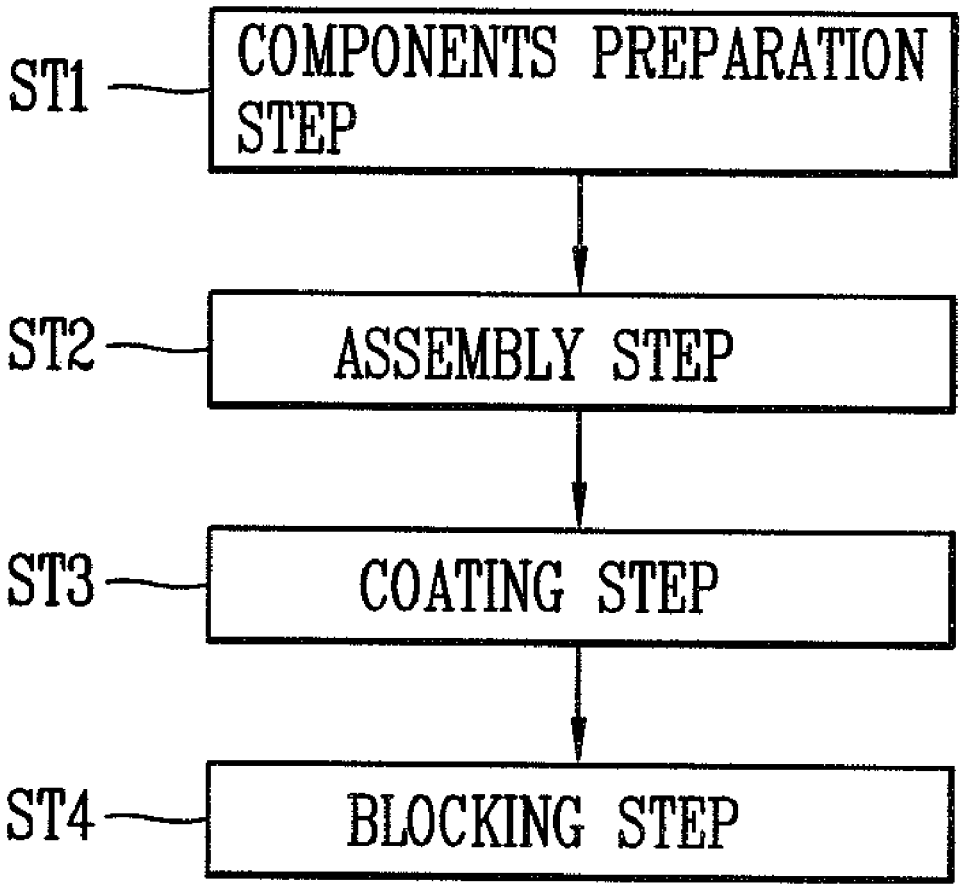
FIG. 5 is a flowchart showing a method for fabricating a high voltage relay according to the present invention.

FIG. 2 is a disassembled perspective view showing components in a high voltage relay in accordance with the present invention, FIG. 3 is a perspective view showing a configuration of an arc extinguishing mechanism in the high voltage relay in accordance with the present invention, FIG. 4 is a perspective view showing that internal air expanded due to a temperature increase within the relay is discharged via a gas discharge hole in a thermosetting resin-coated state, and an enlarged view of a main part, and FIG. 5 is a flowchart showing a method for fabricating a high voltage relay according to the present invention.

First, description will be given with reference to FIG. 2, which is a disassembled perspective view showing components and their assembled state in a high voltage relay in accordance with the present invention.

A high voltage relay according to the present invention is a high voltage DC relay in the air used as a sub relay for a hybrid vehicle or electric vehicle, and may include a molded case 1, an actuator 2 and an arc extinguishing mechanism 3.

The molded case 1 may be formed by molding a synthetic resin having an electric insulating property into a box shape having one open surface. The molded case 1 may serve as an outer case for accommodating therein components of the high voltage relay according to the present invention.

The actuator 2 may be a component, which is accommodated in the molded case 1 for opening or closing a circuit between an external DC power source connected to the high voltage relay according to the present invention and an electrical load (motor). For example, the actuator 2 may include a coil which is magnetized if a control current is applied via a coil terminal 2*a* and demagnetized if the control current is not applied any more, a movable core movable in response to the magnetization and demagnetization of the coil, and a movable contactor connected to the movable core by virtue of a shaft so as to be movable, in response to the movement of the movable core, to a position where it contacts a stationary electrode 3*a* to be explained later or a position where it is separated from the stationary electrode 3*a*.

The arc extinguishing mechanism 3 may function as an extinguishing mechanism for extinguishing arc generated upon an opening or closing operation between the stationary electrode 3*a* and the movable contactor of the actuator 2, and as an upper cover for covering the opening of the molded case 1. The arc extinguishing mechanism 3 may be provided with the stationary electrode 3*a* inserted therein. The arc extinguishing mechanism 3 may be installed to cover the opening of the molded case 1 at the upper side of the actuator 2.

Hereinafter, description will be given with reference to FIG. 3, which is a perspective view showing a configuration of an arc extinguishing mechanism in the high voltage relay in accordance with the present invention. The arc extinguishing mechanism 3 according to the present invention may include a gas discharge hole portion 3*b*, which is blocked when a thermosetting resin coated on the arc extinguishing mechanism 3 for air-tightness is hardened. Referring to FIG. 4, which is a perspective view showing that internal air expanded due to a temperature increase within the relay is discharged through a gas discharge hole in a thermosetting resin-coated state, and an enlarged view of a main part, the gas discharge hole portion 3*b* may include a tubular portion 3*b*-1, a gas discharge hole 3*b*-2, and a groove portion 3*b*-3 formed around the periphery of the tubular portion 3*b*-1. In FIG. 4, a reference numeral 2*a* designates a coil terminal electrically connected to the coil of the actuator 2 having described with reference to FIG. 2.

The tubular portion 3*b*-1 may have a peripheral portion with a predetermined thickness around the gas discharge hole 3*b*-2, and extend from an upper surface of the arc extinguishing mechanism 3 up to a predetermined height.

The gas discharge hole 3*b*-2 may be formed through the tubular portion 3*b*-1 and communicate with the inside of the lower molded case 1. The gas discharge hole 3*b*-2 may be allowed to provide a path through which an internal air expanded due to a temperature increase within the relay in a thermosetting resin coated state is discharged.

The groove portion 3*b*-3 may be formed around the periphery of the tubular portion 3*b*-1 to be lower than an upper surface of the arc extinguishing mechanism 3. After completely discharging the internal air expanded due to the temperature increase within the relay in the thermosetting resin coated state through the gas discharge hole 3*b*-2, when the tubular portion 3*b*-1 is melted to block the gas discharge hole 3*b*-2, the melted tubular portion 3*b*-1 covers the upper side of the groove portion 3*b*-3, accordingly, the upper surface of the arc extinguishing mechanism 3 may be processed to be flat after the blocking (in other words "closing") of the gas discharge hole 3*b*-2.

The thermosetting resin may be an epoxy resin.

Hereinafter, a method for fabricating a high voltage relay according to the preferred embodiment of the present invention will be described with reference to FIGS. 2 to 5.

The method for fabricating the high voltage relay according to the preferred embodiment of the present invention may roughly include a components preparation step ST1, an assembly step ST2, a coating step ST3 and a blocking step ST4.

At the components preparation step ST1, referring to FIGS. 2 to 4, prepared are the molded case 1 formed by molding the synthetic resin having the electric insulating property into the box shape having the one open surface, the actuator 2 accommodated in the molded case 1, and the arc extinguishing mechanism 3, which allows the stationary electrode 3*a* to be inserted therein, has the gas discharge hole portion 3*b* having the gas discharge hole 3*b*-2 in the open state, and covers the opening of the molded case 1. At the components preparation step ST1, the arc extinguishing mechanism 3 may be prepared by molding the arc extinguishing mechanism 3 having the tubular portion 3*b*-1, which has the predetermined thickness from the outer circumferential surface of the gas discharge hole 3*b*-2 and extends up to the predetermined height.

The assembly step ST2 may be performed by accommodating the actuator 2 within the molded case 1 and covering with the arc extinguishing mechanism 3.

At the coating step ST3, the thermosetting resin is coated on the arc extinguishing mechanism 3 excluding the gas discharge hole portion 3*b*.

At the blocking step ST4, when the expanded gas within the molded case 1 is completely discharged via the gas discharge hole 3*b*-2, the gas discharge hole 3*b*-2 of the gas discharge hole portion 3*b* is blocked. Here, the blocking of the gas discharge hole 3*b*-2 may be performed by heating the gas discharge hole portion 3*b* with a high frequency heater. In more detail, the tubular portion 3*b*-1 of the gas discharge hole portion 3*b* is melted by heating with the high frequency heater so as to block the gas discharge hole 3*b*-2. Here, the melted tubular portion 3*b*-1 covers the groove portion 3*b*-3, accordingly, the upper surface of the arc extinguishing mechanism 3 may be processed to be flat after completely blocking the gas discharge hole 3*b*-2.

As mentioned above, the high voltage relay according to the present invention may include an arc extinguishing mechanism provided with a gas discharge hole portion, which is blocked when a thermosetting resin coated on the arc extinguishing mechanism for air-tightness is hardened upon fabrication of the arc extinguishing mechanism. Accordingly, after completely discharging an expanded gas within the relay while the thermosetting resin is hardened, only the gas discharge hole portion may be blocked later, which ensures the air-tightness and thus allow a reliable opening or closing operation of the relay irrespective of an environmental change, such as changes in temperature and humidity, thereby achieving an air-tight high voltage DC relay as a sub relay appropriate to be used for opening or closing a DC electric power source of an electric vehicle or hybrid vehicle.

In the high voltage relay according to the present invention, the thermosetting resin may be an epoxy resin, so the superior electric insulating property of the epoxy resin can be used to electrically insulate portions excluding the terminal parts of the high voltage relay, thereby preventing an electric leakage and an electric contact and ensuring an electric insulation between terminals.

In the high voltage relay according to the present invention, the gas discharge hole portion may include a tubular portion, which has a predetermined thickness from an outer circumferential surface of the gas discharge hole and extends up to the predetermined height. Accordingly, when the tubular portion is thermally bonded upon blocking the gas discharge hole portion, the corresponding tubular portion is melted as well as the gas discharge hole portion is blocked, so as to cover the corresponding portion, thereby allowing the gas discharge hole portion to be blocked firmly and levelly without making the thickness thin.

In the method for fabricating the high voltage relay according to the present invention, after a complete assembly of accommodating the actuator within the molded case and covering the arc extinguishing mechanism, the thermosetting resin is coated on the arc extinguishing mechanism excluding the gas discharge hole portion, and then an opening of the gas discharge hole portion is blocked when an expanded gas within the molded case is completely discharged via the gas discharge hole portion. Hence, formation of gaps due to the discharge of the expanded gas within the molded case and thusly occurred broken air-tightness can be prevented, which allows the air-tightness after fabrication, thereby achieving an air-tight high voltage DC relay as a sub relay appropriate to be used for opening or closing a DC electric power source of an electric vehicle or hybrid vehicle, regardless of the variations of temperature and humidity.

In the method for fabricating the high voltage relay according to the present invention, the blocking step can be configured to block the opening of the gas discharge hole portion by heating the same with a high frequency heater, accordingly, the opening can be simply blocked by virtue of the heating with the high frequency heater, thereby minimizing the affection of the existence of the corresponding process on the productivity of the high voltage relay.

In the method for fabricating the high voltage relay according to the present invention, at the components preparation step, the arc extinguishing mechanism including the tubular portion, which has a predetermined thickness from an outer circumferential surface of the gas discharge hole and extends up to a predetermined height, is molded, accordingly, when the tubular portion is thermally bonded upon blocking the gas discharge hole portion, the corresponding tubular portion is melted as well as the gas discharge hole portion is blocked, so as to cover the corresponding portion, thereby allowing the gas discharge hole portion to be blocked firmly and levelly without making the thickness thin.

In the method for fabricating the high voltage relay according to the present invention, at the blocking step, the tubular portion of the gas discharge hole portion is melted by heating with a high frequency heater so as to block the gas discharge hole, thereby minimizing the affection of the existence of the corresponding process on the productivity of the high voltage relay.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A high voltage relay comprising:

a molded case formed by molding a synthetic resin having an electric insulating property into a box shape having an open surface;

an actuator accommodated in the molded case; and an arc extinguishing mechanism allowing insertion of a stationary electrode therein and installed on the actuator for covering the open surface of the molded case, the arc extinguishing mechanism comprising a gas discharge hole portion, wherein the gas discharge hole portion comprises:

a tubular portion through which a gas discharge hole is formed;

a groove portion formed completely around a periphery of the tubular portion, the groove portion located lower than an upper surface of the arc extinguishing mechanism; and a wall portion formed completely around a periphery of the groove portion.

* * * * *

UNITED STATES PATENT AND TRADEMARK OFFICE

CERTIFICATE OF CORRECTION

PATENT NO. : 8,350,645 B2
APPLICATION NO. : 12/904076
DATED : January 8, 2013
INVENTOR(S) : Young Myoung Yeon It is certified that error appears in the above-identified patent and that said Letters Patent is hereby corrected as shown below:

Title Page

Item [73] Assignee Residence should read: ANYANG, GYEONGGI-DO, REPUBLIC OF KOREA Signed and Sealed this
Twenty-ninth Day of January, 2013

David J. Kappos

David J. Kappos
*Director of the United States Patent and Trademark Office*